US006142846A

United States Patent [19]

Ojakaar

[11] Patent Number: 6,142,846

[45] Date of Patent: Nov. 7, 2000

[54] STUFFED ANIMAL TOY

[76] Inventor: Linda Ojakaar, 8 Jacqueline Dr., Hockessin, Del. 19707

[21] Appl. No.: 09/414,260

[22] Filed: Oct. 7, 1999

[51] Int. Cl.[7] ..... A63H 3/00

[52] U.S. Cl. ..... 446/72; 446/369; 446/485; 446/71

[58] Field of Search ..... 446/175, 369, 446/485, 390, 71–77; 362/124, 189, 190

[56] References Cited

U.S. PATENT DOCUMENTS

| | | | |
|---|---|---|---|
| 1,638,594 | 8/1927 | Myers | 446/74 |
| 4,298,915 | 11/1981 | Goldfarb et al. | 362/124 |
| 4,464,861 | 8/1984 | Fogarty et al. | 446/370 |
| 5,267,886 | 12/1993 | Wood et al. | 446/175 |
| 5,434,761 | 7/1995 | Lesnick et al. | 446/385 |
| 5,791,965 | 8/1998 | Kim | 446/219 |

*Primary Examiner*—Kien T. Nguyen
*Assistant Examiner*—Urszula M. Cegielnik
*Attorney, Agent, or Firm*—Jeffrey C. Lew

[57] ABSTRACT

A stuffed animal toy has a plush, padded body and one or more elongated appendages, such as arms, legs and tail. At least one flashlight module is resident within the appendage oriented to permit a directional beam of light to be emitted outwardly from the appendage. The flashlight module can be activated and deactivated by grasping the appendage and squeezing radially inward in repetition to turn the light on and off. The flashlight module is a self-sufficient battery powered, usually low voltage, direct current lighting unit. In one aspect, the flashlight module can be easily and quickly removed from the stuffed animal and utilized as a normal flashlight, independent of the stuffed animal. After such use, the module can be replaced into the appendage of the stuffed animal. While the module is removed, the stuffed animal can be utilized as a normal, plush toy plaything.

13 Claims, 2 Drawing Sheets

STUFFED ANIMAL TOY

FIELD OF THE INVENTION

This invention relates generally to toys and more specifically to a stuffed animal toy in combination with a flashlight in the animal for use by a child.

BACKGROUND AND SUMMARY OF THE INVENTION

Traditionally stuffed animals are familiar toys which have given much pleasure to adults as well as enjoyment to children. Children derive a sense of comfort, security and companionship in addition to simple playfulness from a stuffed animal toys because of their plush composition and typically appealing design. A directional flashlight is useful for a child to see in the dark, whether for entertainment or practical purposes. It is desirable to have a device that combines both features of a stuffed animal and a directional light suitable for operation by a child. More specifically a need is seen for a stuffed animal with a flashlight removably embedded in an appendage of the animal and which flashlight can be operated from within the animal, or optionally, after removal from, and separate from the animal.

A stuffed animal with the novel combination of features is believed to be unknown in the art. U.S. Pat. No. 4,464,861 discloses a plush toy with a light, however the light is not removable for use outside the body of the stuffed animal toy. Furthermore, the plush toy gives of a diffuse light for general illumination while the light beam is directional in the present invention.

U.S. Pat. No. 5,791,965 provides a stuffed toy horse with an array of light emitting diodes (LEDs) located along the mane. The toy also features an ability to produce sounds synchronized with illumination of the lights. In contrast, the present invention has emits a directional light beam and the light source can be used independently of the animal in the manner of a flashlight.

DETAILED DESCRIPTION

The present invention calls for a stuffed animal toy incorporating a directional beam flashlight embedded therein. The type, size, shape, or color of the animal body is not critical. Hence, the animal can be real or imaginary, and if real, then the same size, larger or smaller than actual animal on which it is modeled. Similarly, texture and material of construction is not critical provided that the animal is durable and preferably can be maintained in a sanitary condition. Preferably the material can be cleaned by washing in a cleaning solution such as soap and water or other commercial liquid cleanser.

The body 10 can be constructed in a conventional manner for stuffed animals. Preferably the bulk of the animal body should have an outer surface 12 comprising a plush fabric that feels soft to the user. Soft feel can be achieved by inserting one or more layers of various thicknesses of padding material under the outer surface. The padding can be formed from comprising compressible woven fabric, nonwoven fabric and/or polymeric foam. The fabric for the outer surface can be a smooth or textured, thick velveteen or similar fabric. The body can have optional trim accessories such as button eyes and yarn hair, for example.

The animal should have a design which incorporates one or more elongated appendages 14. The term "appendage" applies typically to such body parts as arms, legs and tails.

Figure 2:
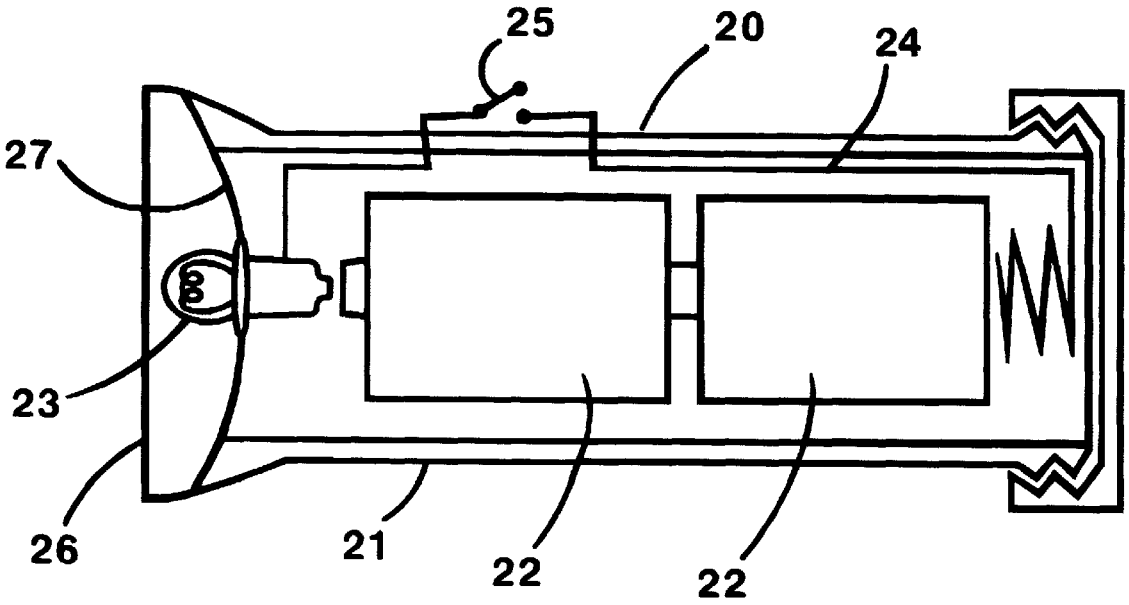
FIG. 2 is a schematic diagram of a flashlight module suitable for use in the present invention.

The exact shape or style of the appendages is not critically important provided that at least one appendage is sufficiently elongated to contain within it an elongated flashlight module 20 (FIG. 2). The term "elongated" means that an object has a characteristic long dimension and a characteristic short dimension, such as the length and diameter of a cylinder, respectively, and that the ratio of the long dimension to short dimension, sometimes referred to as the aspect ratio is usually at least 2:1. It is also preferred that the short dimension be small enough that appendage fit within the grasp of one hand of a small child. That is, the circumference of the appendage should be less than twice the length along the fingers between the index finger tip and the tip of the thumb. Typically, the appendage should have a circumference of about 3–8 inches.

The flashlight module contained within at least one appendage of the stuffed animal toy can be of conventional design. Generally, such modules comprise an elongated case 21 which can hold, one or more conventional, direct current batteries 22, usually at one end of the case. The batteries are typically of a low voltage which is effective to illuminate a direct current light bulb of compatible voltage rating. The batteries are normally connected in series to provide cumulative voltage to illuminate the bulb. The case also contains traditional electrical conductors 24 and a switch 25 to complete a circuit that is effective to operate the flashlight in the traditional manner.

The flashlight also comprises a light beam emitting source at the other end of the case. The light beam emitting source includes a transparent plate 26 covering the bulb and a beam forming means 27 for directing the illumination emitted from the bulb in a beam of light. Usually the beam forming means is a polished, curved reflector as is well known in the art. The curvature of the reflector can be chosen to form a beam of a preselected shape, i.e., narrow or broad cone angle. The reflector and/or the transparent plate also can be adapted to throw the beam in a defined outline onto a receiving surface such as a wall or ceiling. For example the boundary of the plate can be shaped to cast a beam in an outline of an object, character, design, logo or the like. Further, portions of the plate can be made opaque to define features onto the receiving surface, such as the eyes and mouth of a "happy face", for example. The reflector also serves to concentrate the intensity of the light emitted by the bulb in the direction of the beam which makes the beam brighter than would occur if the reflector was not present and the illumination was omnidirectional. Position of the bulb relative to the reflector can be adjustable as another method of focusing the beam. Still further, the reflector directs the beam away from the eyes of the user which allows the user to more effectively view objects illuminated by the beam.

Figure 1:
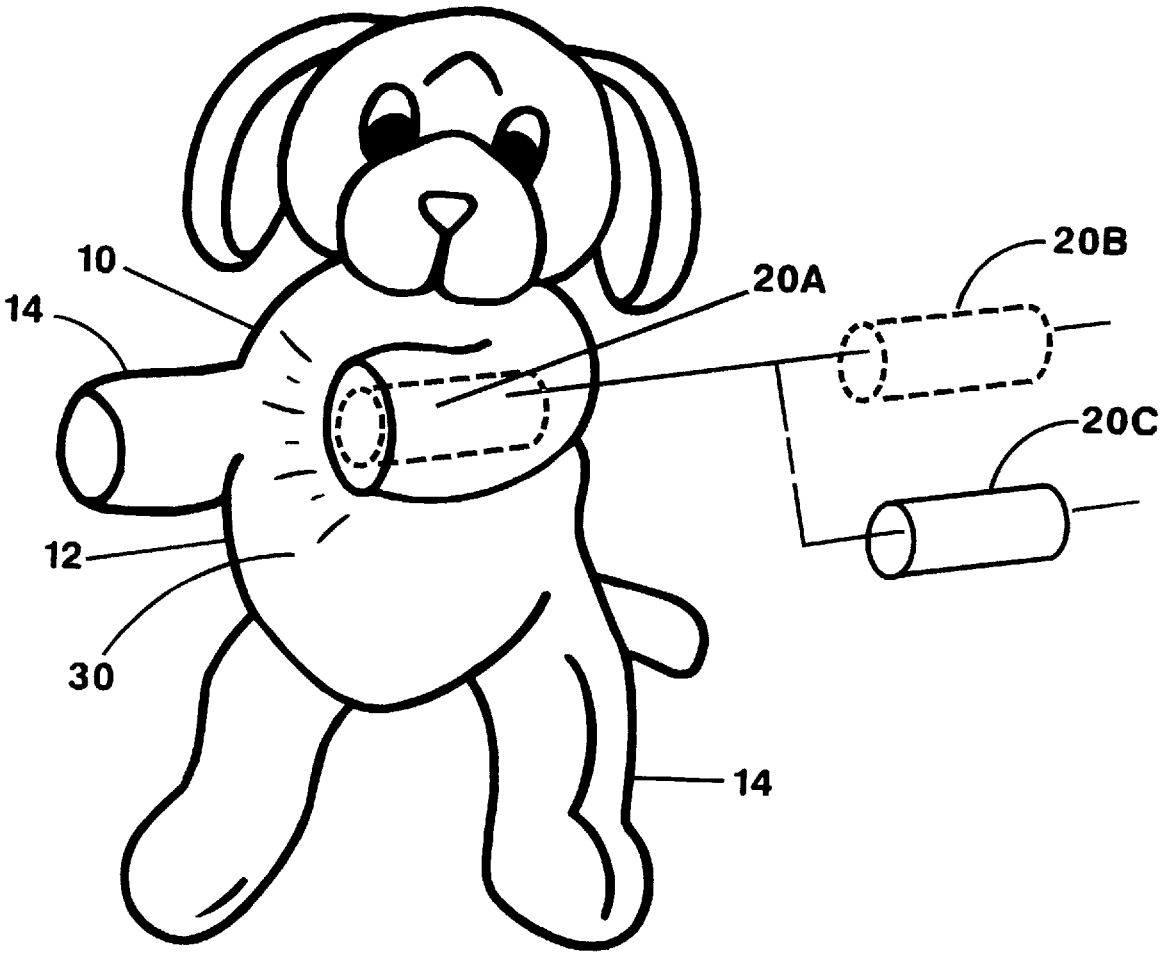
FIG. 1 is a perspective view of a stuffed animal toy according to the present invention.

The flashlight module 20A (FIG. 1) is normally positioned inside an appendage of the animal with the axis of elongation of the module aligned substantially parallel to the axis of elongation of the appendage. The module is oriented so that the beam of light 30 emits outwardly from the appendage. Thus, the transparent cover and bulb end of the module are situated near the end of the appendage, for example at the paw of a toy dog's leg or at the tip of the tail. Accordingly, when utilizing the flashlight feature of the toy, the user would hold the body of the stuffed animal toy while pointing the appendage containing the flashlight module in the direction desired to be illuminated. Then the user can activate the flashlight to emit a beam of light outwardly from the end of the appendage. At end of use, the light can be turned off. Of course, the stuffed animal toy can be utilized as a normal stuffed toy when the light is not illuminated.

Preferably the switch for the flashlight comprises means for activating and deactivating the light by the user applying radial pressure. Accordingly, the primary intended user, a young child, can turn the light on or off by grasping the appendage circumferentially and squeezing. A variety of conventional switch systems can provide this function. Examples include, rocker switches, push button switches, membrane switches and detent switches.

In a basic embodiment of the novel stuffed animal toy the animal has a flashlight module embedded in only one appendage. In another embodiment, the toy has a plurality of modules each positioned in a different appendage. In such a multiple module embodiment, the toy can have a single switch to activate or deactivate all of the modules simultaneously. Alternatively, each module can have its own switch and thus each module can be turned on and off independently of other modules.

In an aspect of the invention, the flashlight module can be permanently embedded within the appendage. A stuffed animal toy with such permanently embedded module should have a resealable entrance through the outer surface to gain access to the module so that spent batteries can be replaced. Optionally, the batteries can be internally rechargeable, in which case the toy should comprise within the body a suitable conventional battery charger and conductors leading to an electrical receptacle accessible through the outer surface.

In another aspect, the flashlight can be replaceably removable from within the appendage. Thus, it can be extricated from the appendage as a unit 20B and used as a flashlight independently of the stuffed animal toy. The appendage should have means for receiving and ejecting the flashlight. For example, the appendage can have an internal tubular sleeve defining a cavity within the appendage into which the removable flashlight module can be inserted. The sleeve insulates the padding material to prevent destruction of the padding when the module is repeatedly inserted and withdrawn. One end of the sleeve near the end of the appendage from which light emits can have a frame defining an outwardly facing opening slightly smaller than the cross section dimension of the module. The frame reinforces the end of the appendage and prevents the module from falling out of the appendage. The opposite end of the sleeve can have a reversibly operable closure, such as a zipper or hook and loop fastener set which can be opened to allow insertion or removal of the module then closed again.

In another aspect, the appendage can be constructed to permit insertion and withdrawal of the module from the light-emitting end of the appendage. For example, the end of the appendage can be formed as a resealable cuff, like a shirt sleeve cuff. The flaps of the cuff can be fitted with hook and loop, button, zipper or similar fastener means along a seam parallel to the axis of the appendage. The cuff should be fashioned to firmly retain the module when the flaps are shut. In connection with a cuff style mechanism for holding the module in the appendage, optionally the exterior of the case and the interior of the tubular sleeve can comprise patches of hook and loop fasteners adapted to mate when the module is inserted.

With the flashlight module removed, the toy can be used in conventional manner, i.e., played with as a child would play with a normal, inanimate stuffed animal or object. Optionally, an elongated pillow 20C of about the same size as the flashlight module and filled with padding material can be inserted into the sleeve to take the place of the removed module. This restores bulk to the appendage which might otherwise collapse when the module is taken out.

Although specific forms of the invention have been selected for illustration in the drawings and the preceding description is drawn in specific terms for the purpose of describing these forms of the invention fully and amply for one of average skill in the pertinent art, it should be understood that various substitutions and modifications which bring about substantially equivalent or superior results and/or performance are deemed to be within the scope and spirit of the following claims.

What is claimed is:

1. A stuffed animal toy comprising a body with appendages protruding therefrom, a flashlight module within and replaceably removable from at least one appendage and positioned so as to emit a directional beam of light outward from the appendage, and an elongated pillow comprising a cover and a filling of padding material, the pillow being operative to be received within the appendage when the flashlight module is removed, in which the body comprises an outer surface of a plush material.

2. The stuffed animal toy of claim 1 in which the module is positioned to emit the beam of light outward from the tail.

3. The stuffed animal toy of claim 1 in which the module is postioned to emit the beam of light outward from an arm or a leg.

4. The stuffed animal toy of claim 1 which further comprises switch means on a switch bearing appendage for activating and deactivating the flashlight module.

5. The stuffed animal toy of claim 4 in which the switch means comprises a switch operable by squeezing the appendage.

6. The stuffed animal toy of claim 1 in which flashlight module is operative apart from the body.

7. The stuffed animal toy of claim 1 comprising a plurality of flashlight modules, each module positioned in an appendage different from those of other modules.

8. The stuffed animal toy of claim 7 which comprises one switch to activate all flashlight modules simultaneously.

9. The stuffed animal toy of claim 7 which comprises a plurality of switches adapted to activate each flashlight module independently of other flashlight modules.

10. The stuffed animal toy of claim 4 in which the body is of a material cleanable with a cleansing solution.

11. A stuffed animal toy comprising a body with a plurality of elongated appendages protruding therefrom, at least one of the appendages defining a cavity at an end of the appendage, a flashlight module operable independently of the body, and a cushion, in which each of the flashlight module and cushion have a shape adapted to fit within the cavity and the appendage is operative to receive, hold, and eject the module and cushion provided that only one of the module and the cushion can occupy the cavity at a time.

12. The stuffed animal toy of claim 11 in which the flashlight can be positioned within the cavity so as to emit a beam of light directed outward from the appendage when the flashlight is energized.

13. The stuffed animal toy of claim 12 further comprising a switch adapted to energize the flashlight when the appendage is sqeezed by a user of the toy.

* * * * *